US009424718B2

(12) United States Patent
Guziel

(10) Patent No.: US 9,424,718 B2
(45) Date of Patent: Aug. 23, 2016

(54) SYMBOL MATCH APPARATUS AND METHOD FOR GAME

(71) Applicant: Alchemy3, LLC, Alpharetta, GA (US)

(72) Inventor: Paul Francis Guziel, Roswell, GA (US)

(73) Assignee: Alchemy3, LLC, Roswell, GA (US)

( * ) Notice: Subject to any disclaimer, the term of this patent is extended or adjusted under 35 U.S.C. 154(b) by 0 days.

(21) Appl. No.: 14/288,496

(22) Filed: May 28, 2014

(65) Prior Publication Data

US 2015/0038207 A1 Feb. 5, 2015

Related U.S. Application Data

(60) Provisional application No. 61/829,802, filed on May 31, 2013.

(51) Int. Cl.
*A63F 9/24* (2006.01)
*G07F 17/32* (2006.01)

(52) U.S. Cl.
CPC ..... *G07F 17/329* (2013.01)

(58) Field of Classification Search
CPC . G07F 17/3258; G07F 17/329; A63F 3/0655; A63F 3/06; A63F 3/0605
See application file for complete search history.

(56) References Cited

U.S. PATENT DOCUMENTS

| | | | | |
|---|---|---|---|---|
| 7,740,243 | B1 * | 6/2010 | Kean | 273/139 |
| 2004/0176158 | A1 * | 9/2004 | Baldwin | 463/17 |
| 2008/0045299 | A1 * | 2/2008 | Bennett et al. | 463/17 |
| 2011/0032078 | A1 * | 2/2011 | Guziel et al. | 340/5.86 |
| 2013/0072293 | A1 * | 3/2013 | Johnson et al. | 463/25 |
| 2014/0295932 | A1 * | 10/2014 | Irwin, Jr. | 463/17 |

* cited by examiner

*Primary Examiner* — Steve Rowland
(74) *Attorney, Agent, or Firm* — Baker Donelson

(57) ABSTRACT

A method and apparatus of aggregating a randomly distributed number of symbol images to a population of consumers using mobile communication devices to scan consumer products or promotional messages. The virtual game card puzzles on the communication devices are populated by the symbols in an order to complete a card and earn a prize or an entry for a drawing to win a prize.

25 Claims, 6 Drawing Sheets

FIG. 3

| | Game Ticket 1 | Game Ticket 2 | Game Ticket 3 | Game Ticket 4 | |
|---|---|---|---|---|---|
| Game Piece 1 | X | | | | Remove game piece from random generator if row is full |
| Game Piece 2 | X | X | X | X | Remove game piece from random generator if row is full |
| Game Piece 3 | X | X | X | | Remove game piece from random generator if row is full |
| Game Piece 4 | X | X | | | Remove game piece from random generator if row is full |
| Game Piece 5 | | | | | Remove game piece from random generator if row is full |
| Game Piece 6 | X | | | | Remove game piece from random generator if row is full |
| | If complete, convert to entry; empty column for new game ticket | If complete, convert to entry; empty column for new game ticket | If complete, convert to entry; empty column for new game ticket | If complete, convert to entry; empty column for new game ticket | |

SYMBOL MATCH APPARATUS AND METHOD FOR GAME

TECHNICAL FIELD

The present invention apparatus and methods for random draw games. More particularly, the present invention relates to apparatus and methods that provide players of random draw games a second opportunity for prize by using non-winning game tickets for entry to a drawing in second opportunity random draw game.

BACKGROUND OF THE INVENTION

Consumer package goods, entertainment and service providers focus on retaining existing customers and generating repeat business. A traditional promotional method employed is the 'bounce back' offer which is designed to exchange a purchased product for a chance to receive added value if you return to purchase more. Typically these offers come in the form of a printed coupon; some are more complex and are offered in the form of a collect to win game piece.

Organizations such as state lotteries, quick service restaurants, grocery stores and other retailers may operate marketing programs in which consumers are encouraged through repeat visits, purchases or other means of collecting or receiving, to obtain an entry ticket to a contest or game that awards prizes to entrants. One execution or implementation of this type of marketing promotion provides a free game card piece divided into multiple sections and then awarding random pieces that match those various sections upon purchase from, visit to, or distribution such as by mail, advertising, or other from, the sponsor of the game.

As consumers frequent the product, the retail location, or receive distributions, they accumulate multiple game pieces that can be used to complete the game card. Some of the game pieces are duplicated at higher frequencies than others. Also, consumers may play multiple game cards to try to complete as many as possible to win multiple prizes. Or they may discard the pieces and play to finish a single card. Upon completion of the collecting of the game pieces required for the game card, the card can be exchanged for a prize or an entry for a chance to win a prize in the contest. Typically, such contests are random draw games.

Lottery game providers seek to assist marketing of random draw games by providing game players with a second opportunity random draw game that uses the non-winning game tickets in a subsequent random draw game. A significant drawback to such second opportunity games is tracking the entry and the possession of the non-winning game tickets for the second opportunity game. Game tickets for random draw lottery games are conventionally sold through lottery retailers. The retailers receive the entry payment from the game player in exchange for a game ticket. The retailer during the exchange transaction communicates the details of the game ticket purchase to the game provider. These details include the game information including game and date of the drawing of the game, the game numbers selected for play on the game ticket purchased by the player, validation and authentication information for validating the game ticket if the numbers for play are selected as winning numbers during play of the game, and other conventional lottery game information.

While suitable for issuing game tickets to players for a random draw game, the existing lottery ticket distribution system is not readily practical for receiving and using issued game tickets in a subsequent random draw game of non-winning game tickets as a second opportunity game to retain player's interest in the random draw games of the game provider and reward game players who regularly play lottery games. It is to such that the present invention is directed.

SUMMARY OF THE PRESENT INVENTION

The present invention meets the need in the art for a second opportunity random draw game based on non-winning game tickets purchased by a game player. In one aspect, the present invention provides a system featuring a second opportunity random draw game apparatus within a retail technology for retainage and generation of sales activity, comprising a provider operative within a retail technology that offers a plurality of goods to a plurality of consumers and at least one random draw game having a plurality of tickets, each ticket for use by a respective one of the plurality of consumers to receive an award from the provider based on each ticket having a status of either a winning ticket for the award or a non-winning ticket as determined from time-to-time by the provider. The game provider also offers a second opportunity game to the consumers who periodically have possession of at least one non-winning ticket, each of said consumers associated with at least one second opportunity ticket, each second opportunity ticket having a predetermined number of unfilled symbol spots each designated by a respective one of a plurality of symbols and to be filled by said one consumer with said non-winning ticket, and a respective one of the second opportunity game tickets, upon completion of filling the symbol spots, being released for play in the second opportunity game. A controller is configured for receiving the non-winning ticket, selecting a game piece having a respective one of the symbols from a pool of game pieces, determining whether the selected game piece symbol matches an unfilled symbol spot of the second opportunity tickets associated with said consumer, and releasing a completed second opportunity ticket having each of the unfilled symbol spots filled for play in the second opportunity game. The controller is configured for comparing the symbol of the selected game piece with each of the plurality of second opportunity tickets of the respective one of the consumers to find an unfilled symbol spot thereon matching the symbol of the selected game piece and filling the unfilled symbol spot thereof. The controller, upon determining that the symbol associated with the selected game piece does not fill one of the symbol spots of any of the second opportunity tickets associated with the consumer, withdraws the symbol from the pool for said consumer and selects another game piece from the pool. The consumer, being encouraged by the second opportunity ticket being completed upon filling each symbol spot thereof by withdrawal from the pool of the symbols filled on the second opportunity tickets associated with the consumer, continues to seek tickets from the provider within the retail technology.

In another aspect, the present invention provides a method of retention of consumers within a retailing technology by completing second opportunity tickets for play of a second opportunity random draw game, comprising the steps of:

(a) offering by a provider within a retail technology offering a plurality of goods to a plurality of consumers at least one random draw game having a plurality of tickets, each ticket for use by a respective one of the plurality of consumers to receive an award based on having a status of a winning ticket as determined from time-to-time by the provider or otherwise said ticket having a status of a non-winning ticket;

(b) offering a second opportunity game by the provider to the consumers, each consumer associated from time-to-time with at least one non-winning ticket and at least one of a plurality of second opportunity tickets, each second opportunity ticket having a predetermined number of unfilled symbol spots each symbol spot designated by one of a plurality of symbols and to be filled by a symbol selected from a pool of the symbols, and a respective one of the second opportunity tickets, upon completion of filling the symbol spots, being released for play in the second opportunity game;

(c) operating a controller configured for selecting the symbol from the pool of symbols and determining whether the selected symbol matches an unfilled symbol spot of one of the second opportunity tickets associated with the consumer, whereby a completed second opportunity ticket having each of the unfilled symbol spots filled is released for play in the second opportunity game; and (d) the controller further configured for, upon determining that the selected symbol does not fill an unfilled symbol spot of any one of the second opportunity tickets associated with the respective consumer, withdrawing the selected symbol from the pool before repeating step (c);

whereby the completion of the second opportunity ticket by repeating step (c), retains the consumer for the provider within the retailing technology.

Objects, advantages, and features of the present invention will become apparaant upon reading of the following detailed description in conjunction with the drawings and the appended claims.

BRIEF DESCRIPTION OF THE DRAWINGS

FIG. 3 illustrates the feature of the capped random selection of game pieces in accordance with an embodiment of the second opportunity game in accordance with the present invention.

DETAILED DESCRIPTION

Figure 1:
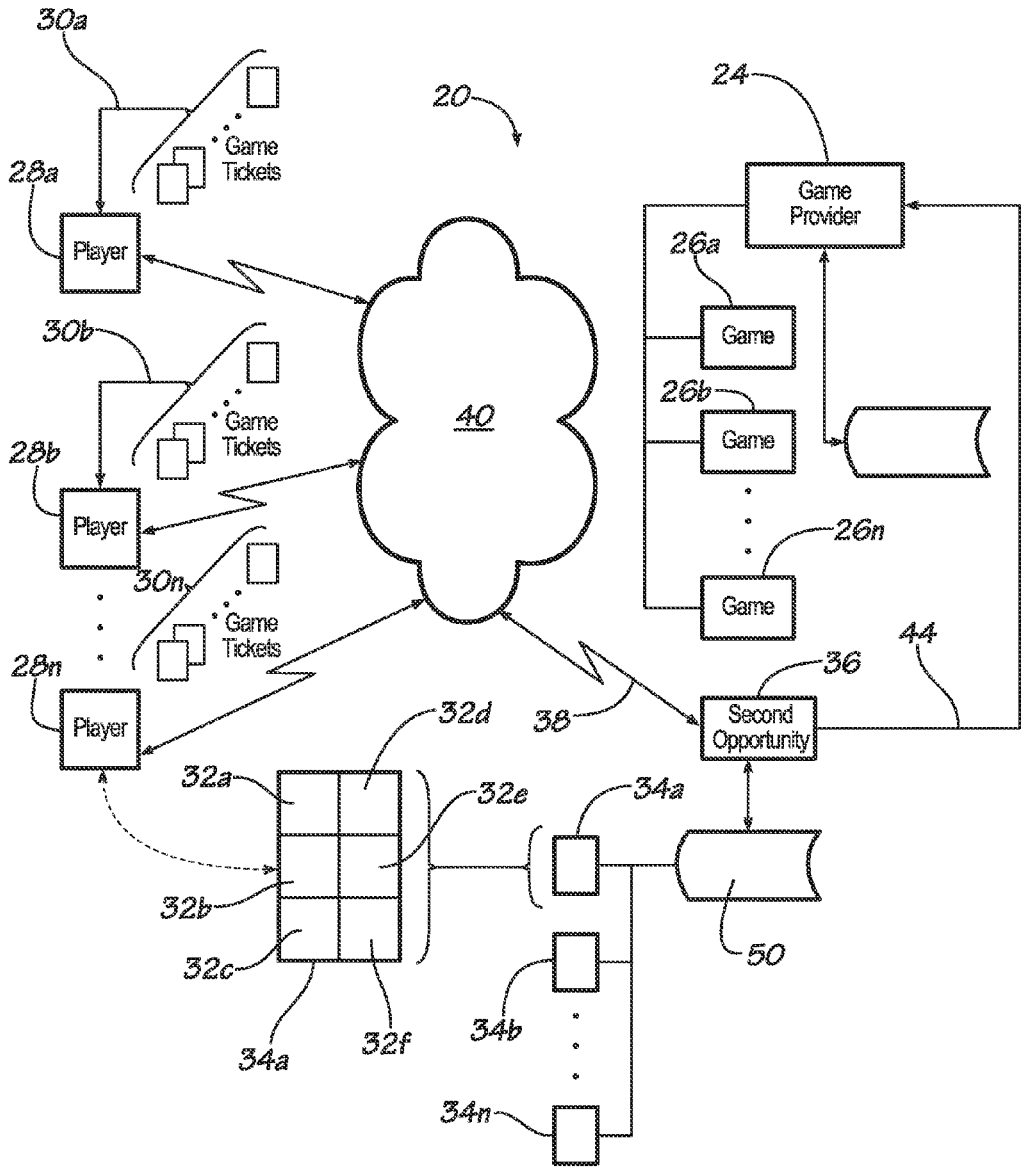
FIG. 1 illustrates a schematic diagram of a second opportunity game in accordance with the present invention.

With reference to the drawings in which like components have like reference numerals, FIG. 1 illustrates a schematic diagram of a game apparatus 20 featuring a second opportunity game 22 provided by a game provider 24 in accordance with the present invention. The game provider 24 offers one or more random draw games 26 that conventionally provide game players 28 with game tickets 30. A database 31 tracks game tickets 30 purchased by game players for play in the game. The game tickets 30 provide entry to the selected game 26 of the game provider 24. The database 31 typically includes for each game ticket 30 a unique game ticket identifier and the game numbers selected for play with the game ticket. The play of the game (typically by random selection of a plurality of winning game numbers from a pool of game numbers) selects a winning game ticket. A game player 28 holding a game ticket with game numbers that match those randomly selected during play wins a prize. It may be that more than one game player holds a winning game ticket as multiple players may have selected the same game numbers for play. In some instances, no game player holds a winning game ticket, and in such event, game prizes typically roll-over to the next play of the game. The game players obtain new game tickets for the occurrence of that game and the prize potentially awarded from play of the subsequent game is increased in value over that prize from the earlier game. The non-winning tickets typically are discarded.

However, in accordance with the present invention, the game player 28 may submit each non-winning ticket 30 for exchange for one of a plurality of game pieces 32. The game pieces 32 populate a second opportunity game card 34 that provides entry to the second opportunity game 22. The second opportunity game card 34 may be physical or virtual. The game card 34 in one embodiment requires collecting one of each different symbol that is associated with the plurality of game pieces 32. Completing the collection of the different symbols provides entry through the game card 34 into the second opportunity game 22.

The game player 28 submits 42 the non-winning game ticket 30 through the network 40 to a controller 36 for play of second opportunity game 22. The controller 36 communicates 38 through the network 40. In a first embodiment, the second opportunity game 22 may be independent of the game provider 24. The controller 36 may communicate 44 with the databases 31 associated with the games 26 of the provider 24 in order to populate game ticket identifiers for validation after submission by the game player 28. For example, the game provider 24 may provide update data records for the database 50 of game tickets sold by retailers for the games 26. The database 50 thus is a third party database with a copy of game ticket identifiers for game tickets sold by the game provider 24 for the games 26.

In a second embodiment, the database 50 is populated upon submission by a player 28 of the non-winning ticket 30. The player 28 retains possession of the game ticket 30 for validation of qualification for play in the second opportunity game 22 if the entry by the player is selected as a winning entry.

Upon submission of the game ticket 30, the controller 36 conducts at least limited validations. This includes but is not limited to verifying that the identifier of the game ticket 30 contains the correct number of digits or alpha characters, verifying that the identifier is not a duplicate of an identifier already submitted, and verifying a check digit or alpha character within the identifier.

In an alternate embodiment, the purchase/sales system selling game tickets preloads each game ticket with a unique identifier. A trailer ticket issues at the time the game ticket is purchased. The identifier of the trailer ticket is submitted to the second opportunity game controller 36. One of the plurality of symbols (or game pieces 32) is preassigned to the identifier. Upon validation of the identifier, the game player is notified of the game piece 32 and its population in association with the game card 34.

In the illustrated embodiment, the game player 28 uses an interactive control application 46 resident on a mobile communications device 48 for submitting the game ticket 30 to the second opportunity game 22, through the network 40. In an alternate embodiment, a player 28 may use a stand-alone personal computer equipped with networking capability to access a network website for submission of the game ticket 30.

Figure 2A:
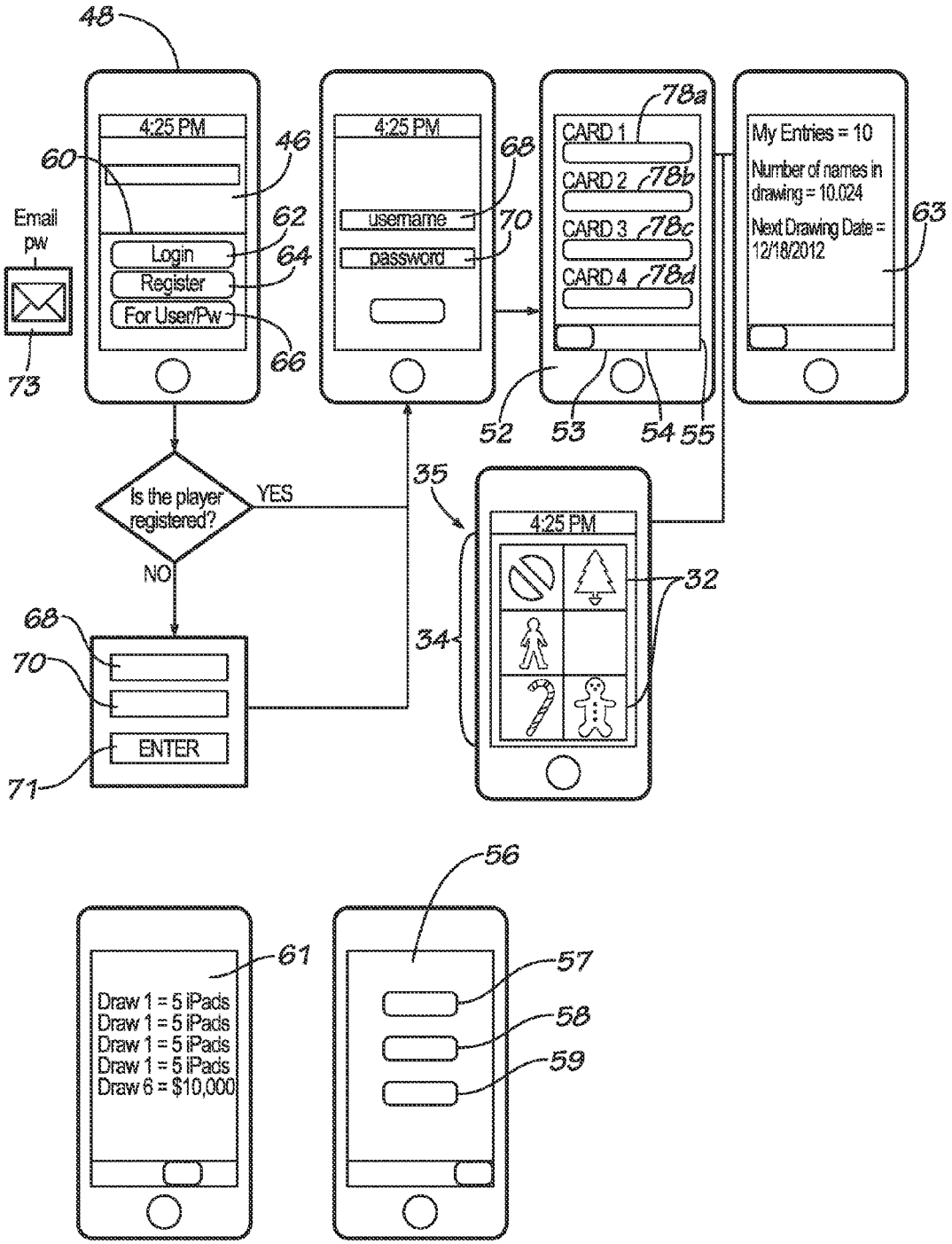
FIGS. 2A and 2B illustrate as a flow chart the processes of the second opportunity game illustrated in FIG. 1 in which a game player obtains game pieces for completion of a second opportunity game ticket and submission of a completed second opportunity game ticket for entry to the second opportunity game.
Figure 2B:
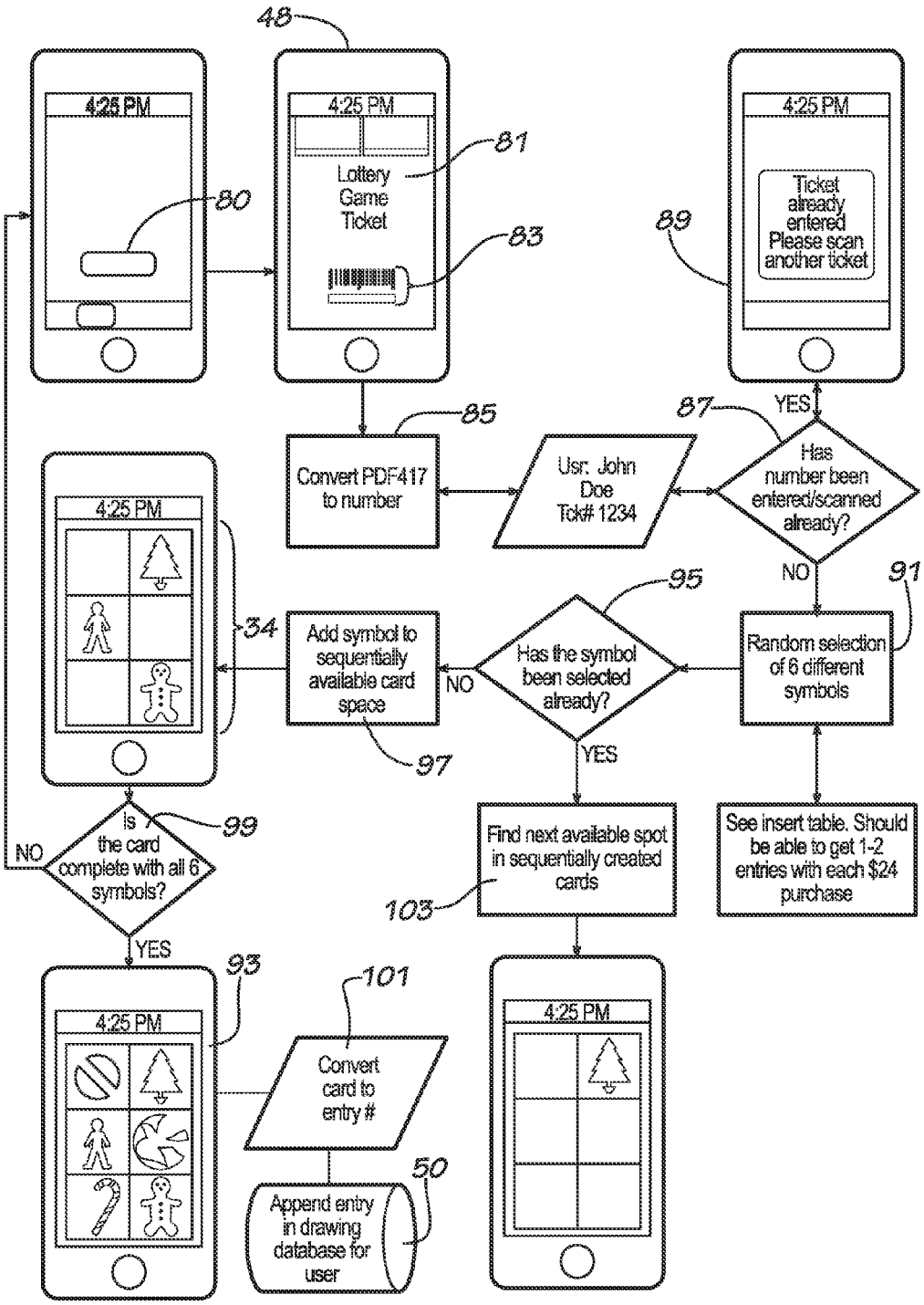

FIGS. 2A and 2B illustrate as a flow chart the processes of the second opportunity game 20 illustrated in FIG. 1 in which the game player 28 obtains the game pieces 32 for completion of the second opportunity game card 34 and submission of a completed second opportunity game ticket as an entry for the second opportunity game 22. The game player 28 installs the second opportunity game application 46 on his mobile communications device 48. The game application 46 communicates through the network 40 with the controller 36 for the second opportunity game 22. In an alternate embodiment, the game player 28 may access the controller 36 through a conventional computer equipped for network communication through a remote web site operated by the game provider 24.

The game application 46 when operated provides a log-in screen 60 on the display of the mobile communications device 48. The log-in screen 60 provides for log-in 62 of the game player 28 registered with the second opportunity game 22, for registering 64 initially, and for recovery 66 of a password. For log-in, the game player 28 enters a pre-selected and registered user-name 68 and password 70. The user-name and password 68, 70 are selected 71 by the game player during initial registration. The application 46 provides for email 73 of the game player's password to an email address specified by the game player.

The mobile communications device 48 includes a unique identifier, and the controller 36 receives and records the device identifier in association with the user-name and password of the game player 28 in the database 50 of game players for the second opportunity game 22.

Once logged-in, the application displays a status of the second opportunity game tickets that the game player is completing by submission of non-winning game tickets. A command line 51 provides access to a home page 52, to the scan process 53, to a list of available prizes or awards 54, and assistance 55. An assistance screen 56 accessed from the assistance button 55 provides access to game rules 57, game questions and answers 58, and customer service contact 59. Selecting the game rules 57 button displays the game rules; the questions and answers 58 displays FAQs; the customer service contact 59 displays a phone number and/or an email address for requesting game assistance. The available prizes 54 displays 61 prizes to be awarded for particular ones of the second opportunity game.

The home button 53 displays game information 63; for example, the number of game ticket entries submitted by the game player, the total number of entries in the drawing, and the date for the next play of the second opportunity game.

Once logged-in, the application 46 displays 76 the status of the game tickets 34 associated with the game player. The display 76 shows as a bar graph 78 the percent of completion of the game card 34. In the illustrated embodiment, the game player 28 has four game tickets 34 that are in process of being completed with game pieces 32. Selecting one of the bar graphs 78 displays 35 the game card 34 and the game pieces 32 received and associated with the game card. Game pieces 32 remaining are shown in blank or faded to distinguish from those game pieces already associated with the game card 34.

The game player 28 submits a non-winning game ticket 30 to the second opportunity game controller 36 to receive one of the game pieces 32. This is accomplished by selecting the scan button 53 that displays the scan feature 80. Selecting the scan feature button 80 activates an imaging or photography feature of the mobile communications device 48. The game ticket 30 is displayed 81 on the screen of the mobile communications device 48 for imaging of the game ticket identifier 83 printed on the game ticket. The image is recorded. The unique identifier of the game ticket may be an alphanumeric representation although such identifiers are increasingly displayed as 2-D or 3-D bar codes or QR codes. The identifier is converted 85 to a digital code and communicated with the identifier of the mobile communications device 48 to the controller 36. The controller 36 interrogates 87 the validity of the game ticket identifier as discussed above.

The submission is rejected if the game ticket identifier is invalid, for example, due to a communications error, improper number of digits or alpha characters, improper check digit, or the game ticket was already submitted. If the identifier is invalid, the game player 28 may re-scan and submit the game ticket identifier again. If an interrogation of the database 50 of the second opportunity game 22 determines the game ticket has already been presented to the second opportunity game, the submission is rejected and a message displayed 89 on the screen of the mobile communications device 48.

The controller 36 generates 91 a game piece 32 in response to a valid submission of a non-winning game ticket. The generated game piece is one of a plurality of different game pieces symbols) available in the pool of game pieces. In the illustrated embodiment, the game piece 32 results from a random selection from six possible different game pieces 32*a*-32*f* required to complete the game card 34.

The number of different game symbols depends on the difficulty level established by the game provider for its second opportunity game 22. For example, six different game pieces provides a reasonable number in the pool, allowing players to create an entry to the second opportunity game 22 without reduced frustration and minimizing the player losing interest in the second opportunity promotion.

The illustrated embodiment used at holiday season uses symbols for Christmas tree ornament, Christmas tree, toy nutcracker, a dove symbol, a candy cane, and a gingerbread man (as shown at 93). The symbols may be selected for association with events or seasons during which the second opportunity game is available for play by the game provider.

The controller 36 checks 95 the game card 34 associated with the mobile communications device 48. If the selected game piece 32 is not associated with the game card 34, the game controller 36 associates 97 the game piece 32 with the game card 34 and a message of congratulations displays on the mobile commuter device 48. The controller 36 checks to see if the game card 34 is complete 99 with the required game pieces 32. Upon completion, the game card 34 is entered 101 in the second opportunity game 22 in association with the identifier of the mobile communications device 48. The game player may then scan and submit another non-winning game ticket 30. If the selected game piece is already associated with the game card 34, a message is displayed on the mobile communications device. The application returns the game player to the scan page for a next submission of a non-winning inning ticket.

In another aspect, the second opportunity game 22 however may provide for the game player 28 to have a plurality of active game cards 34 for completion 103 during a submission of a game ticket 30. In the illustrated embodiment, four game tickets 34 may be active. Thus, in the event the selected game piece 32 is already associated with a first one of the game cards 34, the game controller 36 checks a subsequent game card 34 sequentially to find an available spot for the selected game piece 32. After a game card 34 is completed, the completed game ticket is submitted 101 as an entry to the second opportunity game 22. This leaves three partially completed game tickets. The application 46 may start a new game card 34 to provide four game cards active for checking sequentially to receive a game piece in response to scanning of a subsequent non-winning game ticket 30 by the player.

The second opportunity game 22 using a plurality of game cards 34 further practices controlled random outcome of game piece 32 selection by using a cap on the number of game pieces 32 (or symbols) that may be randomly selected without completing a game card 34. FIG. 3 illustrates a symbol randomizer table that implements the feature of the capped random selection of game pieces 32 in accordance with an embodiment of the second opportunity game 22. The illustrated embodiment requires six different game pieces 32 for each completed game card 34. The cap is four of a particular one of the game pieces (or symbols) selected without generating a completed game ticket. A symbol that reaches its cap is then withdrawn from the random generator pool of available game pieces. The withdrawn symbols re-activated in the pool after one of the game cards 34 is completed. The four symbol cap and six different symbols per game card 34 limits the maximum number of non-winning game tickets to 21 before a game card 34 is completed.

With reference to FIG. 3, the controller 36 tracks the four game tickets 34 and the game pieces 32 for each game card 34. The symbol (or game piece 32) is removed from the pool of game pieces 32 if each of the four game tickets 34 have the game piece. In the illustrated table, Game Ticket 1 is partially complete with Game Pieces 1-4 and 6. Game Piece 2 has been drawn four times and each of Game Tickets 1-4 are marked or associated with Game Piece 2. Game Piece 2 is therefore withdrawn from the pool for random selection of a game piece 32. If a Game Piece 3 is the symbol next drawn after scanning of non-winning ticket, the application would selectively associate Game Piece 3 with Game Ticket 4. The Game Piece 3 having reached its cap would also be withdrawn from the pool. If a Game Piece 5 is the symbol next drawn after scanning of a non-winning ticket 30, the application would selectively mark Game Ticket 1 as receiving Game Piece 5. In this example, Game Ticket 1 is then complete. The application enters a game ticket for the game player to the second opportunity game 22. The Game Ticket 1 fields for Game Pieces are cleared to form a new game card 34 for receiving game pieces 32 during operation of the application. The withdrawn Game Pieces 2 and 3 return to the pool for possible random generation upon submission of a subsequent valid game ticket 30.

Figure 4:
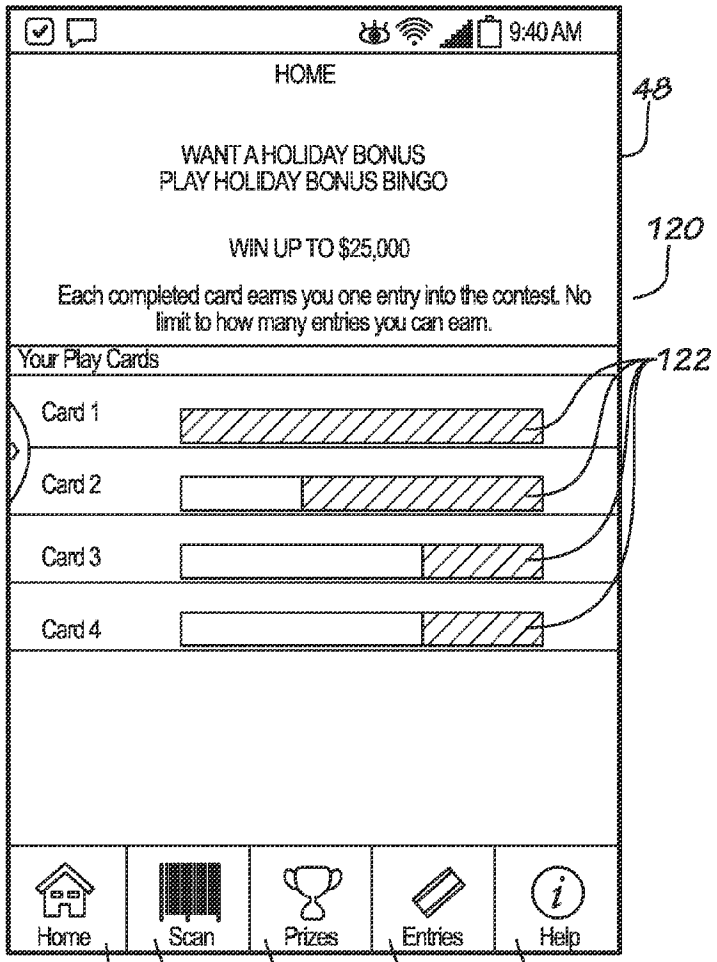
FIG. 4 illustrates a display of the second opportunity game application configured for operation on a mobile communications device.

FIG. 4 illustrates a display on the mobile communications device 48 showing an illustrative home page 120 of the second opportunity game application 46. In this embodiment, the display presents the completion status 122 of each of the pending four game tickets 34. The game player may select one of the identified game tickets to display as shown in FIG. 5 the game pieces 32 received for the selected game card 34.

Figure 5:
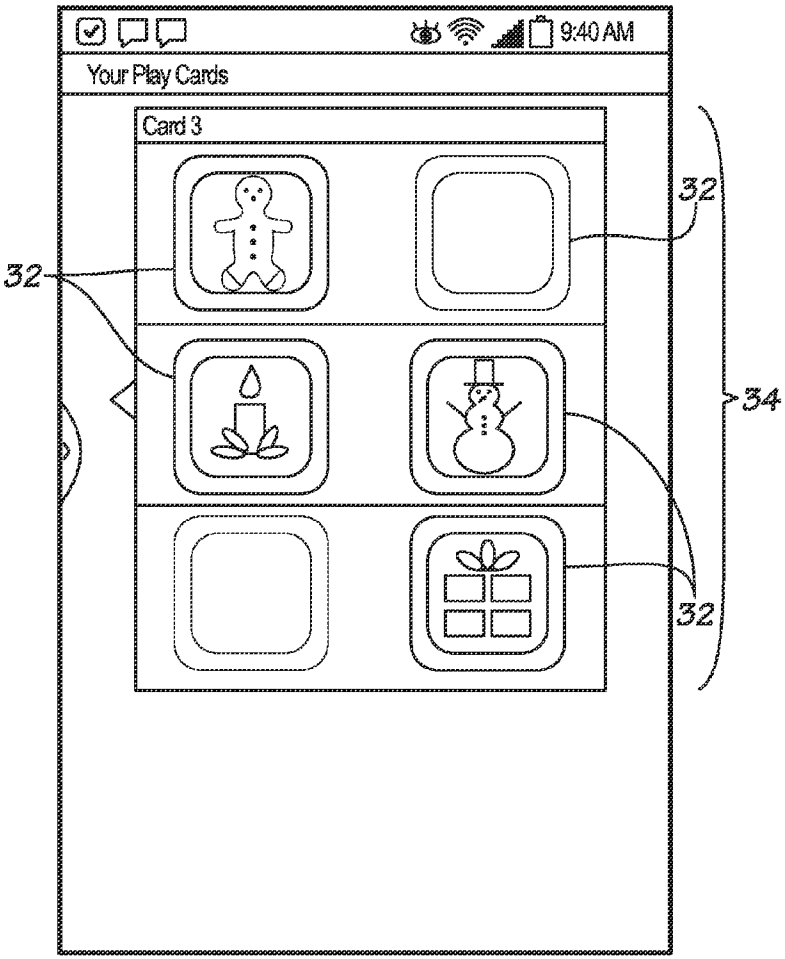
FIG. 5 illustrates a display of a second opportunity game ticket partially completed with game pieces during operation of the second opportunity game application, in which the game pieces are displayed on a mobile computer device or smartphone as an opaque image and associated game pieces are in contrasting color or visibility.

FIG. 5 illustrates a display of a selected second opportunity game card 34 partially completed with game pieces 32 during operation of the second opportunity game application 46. The game pieces 32 remaining to be received from the random draw after submission of a non-winning game ticket 30 are illustrated with an opaque or phantom image of the symbol associated with the game piece 32.

Figure 6:
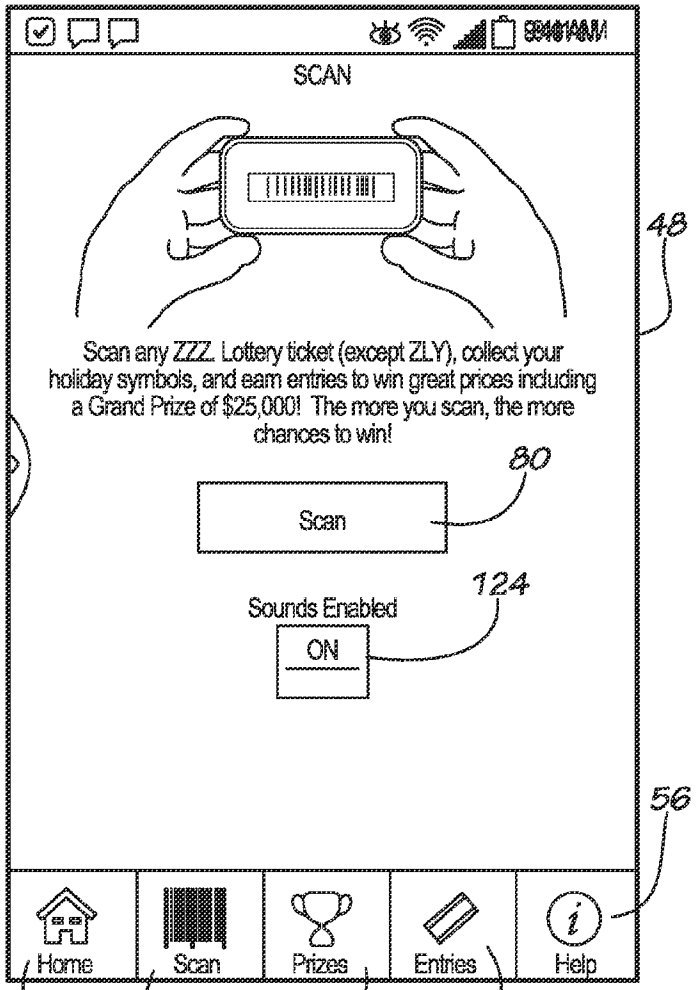
FIG. 6 illustrates a display on the mobile communications device during a scan of a non-winning game ticket during operation of the second opportunity game application for selection of a game piece for the second opportunity game ticket.

FIG. 6 illustrates a display on the mobile communications device 48 generated in response to the scan button 53 in preparation for the game player to scan a non-winning game ticket 30. The display illustrates how to hold the mobile communications device 48 for imaging the identifier of the game ticket 30. The scan button 80 initiates the imaging process discussed above. A sounds switch 124 toggles between sound-on and sound-off. during operation of the second opportunity game application for selection of a game piece for the second opportunity game ticket.

Figure 7:
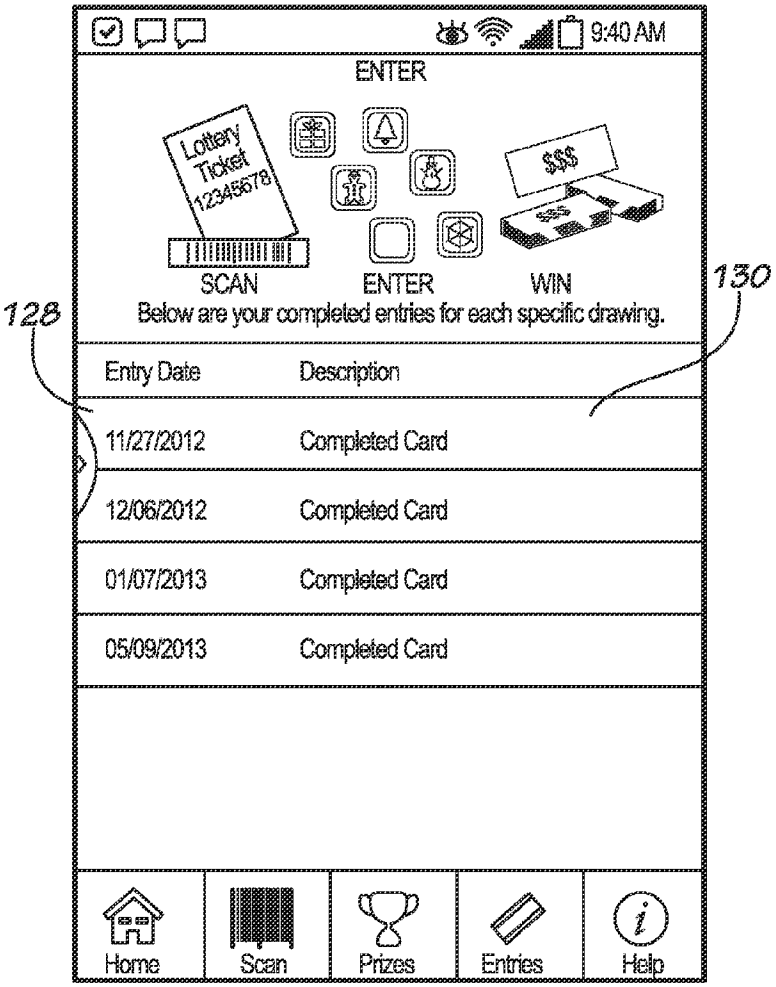
FIG. 7 illustrates a display of second opportunity game tickets for a game player during operation of the second opportunity game application.

FIG. 7 illustrates a display 126 of second opportunity game tickets 34 for the game player 28 during operation of the second opportunity game application 46. The display 126 lists the game entry date 128 and a description 130.

In practice of the second opportunity game 20, the game player uses a mobile communications device 48, such as a smartphone or tablet computer, that renders a series of game card images on the screen. The images are outlined and transparent to show the final image, but indicate that the pieces have not yet been collected.

In one embodiment, the game provider may use game numbers and corresponding barcodes that are generated on a lottery ticket. These numbers can be generated specifically for play of the second opportunity game, or the existing ticket serial numbers may be used. The method can be employed securely as long as the number is unique and can be validated back to an existing game ticket, The game player uses the scanner or imaging module within the mobile communications device 48 to capture the barcode of the game ticket 30. The game application 46 resident on the mobile communications device 48 converts the barcode to a number. The mobile communications device 48 makes a remote connection to a secure webserver of the game provider and transmits that number to the database. The server runs a database query that checks that number against an existing list of valid numbers. If the number doesn't match, the server returns a response to the mobile device that displays "Not a valid number". If the number does match a number in the table, the server selects symbol that is related to/associated with that number and returns it back to the communication device.

Once the symbol is returned, the application finds the matching position in one of the virtual game cards 34 and converts that transparent section to a solid color or image, representing a matching piece.

In a second embodiment of the method, the ticket identification numbers are randomly generated in advance of the second opportunity game promotion and prepopulate into the lottery game system. The identifiers are drawn and used on "trailer tickets" after a specific dollar value of tickets are purchased. For example, a $5 purchase of game tickets would generate a 'trailer ticket' that has a predetermined unique value barcode on the trailer ticket.

The remote database has a table of all qualifying ticket numbers. These are pre-populated on the database and duplicated in the lottery ticket system. The numbers are encrypted to protect the lottery from any fraudulent activity. Each ticket number in the database has a randomly assigned symbol id. The frequency of any symbol id in the database is determined by the odds of winning any individual prize.

In one embodiment, the game provider 24 may have a low tier prize in high quantities are to be distributed more freely. The symbols representing that prize may be assigned with a higher frequency than all the other symbols and thereby increase the opportunity that a completed game card 34 is selected as a winner of that prize.

In another embodiment, the lottery may have a high tier prize in such low quantities that there may only be one in the entire prize pool. That prize may have a high frequency of 90% of the symbols 32 required to complete the game card, but the remaining 10% of the pieces are distributed in very low quantities. These symbols become 'chase symbols' that prompt consumers to purchase or visit more frequently in order to find and complete the game card.

In a drawing version of the method, a game provider 24 may want to promote an incremental purchase, but limit that purchase so as not to discourage the consumer. In this situation, the game provider would award entries into a drawing rather than actual prizes. The virtual game cards may be duplicated to show the same images or set of symbols. The game provider may set the high/low limits of the player purchase by fixing the number of symbols on a game card and the number of available game cards.

The following illustrates the first method of generating an "Entry" into the second opportunity game 22 instead of generating a tiered quantity of assigned symbols. The game provider allows a player to earn an entry into the drawing by spending no less than a minimum amount and no more than a maximum amount. In an embodiment for games with $1 game tickets with a four piece cap and a pool of six different symbols, the minimum expenditure amount is $6 and the maximum is $21. To achieve a balanced approach to providing an entry to the second opportunity game, the present invention uses game cards 34 that have 6 symbols/places for receiving a game piece 32 and each player has 4 virtual game cards at one time. With each barcode scan/number entry made by the game player, one of the 6 symbols is randomly selected. The game application then searches the four virtual game cards to find an available space to occupy in any of the game cards. If the first card already has that symbol, the game application advances to the next game card. If all 4 game cards already have that space occupied, that symbol will no longer be available for random selection, until a game card is completed and released for entry to the second opportunity game 22.

Using this method in a $1 play game, a player can get all 6 symbols after spending $6 but will have at least one card complete after spending $21 and likely multiple game cards after spending $24. Each completed game card will generate a single entry into a drawing for that consumer. Once the card is complete, it resets to a blank card so there are always 4 game cards open for every played. Alternatively, there may be a limit to a card regenerating. If there is a fixed number of prizes in a pool and the allocated amount of any given prize has been awarded, a card may not regenerate. So in a game where the chase card has been found and the top prize is awarded, a player would not receive that same card because they could no longer collect to win that prize.

A single game card may contain a variable number of game pieces 32 required to complete an image. The greater the number of pieces, the more difficult to complete and requires more consumer activity.

Additional game cards 34 may be introduced to represent different prizes or to receive or house duplicate generated game pieces 32. Game cards 34 may be generated dynamically based on the number of duplicate symbols that are randomly generated or they may be fixed and limit the number of any duplicate symbols that are generated.

Consumers can generate any of the possible symbol images by manually entering an assigned code or scanning a barcode with a scanner module included in the promotional software. The barcode and number may be provided in any number of different printed vehicles. These may include but are not limited to, a lottery ticket, register receipt, direct mail piece, newsprint ad, point-of-purchase tear pad, product packaging or email message, QR code, or other.

The game ticket identifier or code must be a unique indexed number. If a duplicate number is entered, an error will be generated on the mobile communications device. Each unique number may be randomly pre-assigned one of the specific symbols. Depending on the goals of a promotion using the present invention, symbols may be purely random generated from a list of possible symbols, or the symbols may be weighted at differing, amounts to provide a chase to complete a second opportunity game card.

The more limited the piece, the more controlled the liability to award prizes.

In a second embodiment, the database 50 has a table of all qualifying ticket numbers. These are pre-populated on the database and duplicated in the lottery ticket system. The numbers are encrypted to protect the lottery from any fraudulent activity. Each ticket number in the database has a randomly assigned symbol id. Each symbol id equates to apiece of each of the available game cards puzzles. The frequency of any symbol id in the database is determined by the odds of winning any individual prize.

In one embodiment, each virtual game card represents one of the prizes available in the promotion. One such example may be an image of a new car. That image may be divided into 12 different pieces using a 2×6 grid or a 3×4 grid. The symbols that make up those 12 spaces may be distributed in quantities of: sym1=100,000, sym2=50,000, sym3=50,000, sym4=100,000, sym5=25,000, sym6=50,000, sym7=25,000, sym8=100,000, sym9=5,000, sym10=50,000, sym11=25, sym12=5. This will ensure that most players will fill a majority of the game card and continue to play to find the last 2 symbols, but only 5 people may possibly claim the prize. In addition to the possibility that any five people may match all 12 numbers, the odds are high as the limited number of the last 2 symbols are also geographically distributed over the territory of the promotion.

All the other prizes being awarded in the promotion shall be represented with different game cards.

The entries may be accumulated and assigned to the player associated with the submission such as sing the identification number of the mobile communications device of the player. At any point, an RNG (random number generator) can be applied against a table of completed entries to determine the winners of the assigned prizes.

The apparatus and method disclosed herein can be made and executed without undue experimentation in light of the present disclosure. While the apparatus and methods of this invention have been described in terms of illustrative embodiments, it will be apparent to those of skill in the art that variations may be applied to the apparatus and in the method steps or in the sequence of steps thereof described herein without departing from the concept, spirit and scope of the invention. All such similar substitutes and modifications apparent to those skilled in the art are deemed to be within the spirit, scope and concept of the invention as defined by the appended claims.

What is claimed is:

1. A system featuring a game apparatus operative within a retail technology for retainage and generation of sales activity therein, comprising:

a provider operative within a retail technology that offers a plurality of goods to a plurality of consumers and at least one random draw game having a plurality of tickets, each ticket for use by a respective one of the plurality of consumers to receive an award from the provider based on each ticket having a status of either a winning ticket for the award or a non-winning ticket as determined from time-to-time by the provider;

a second opportunity game offered by the provider to the consumers who periodically have possession of at least one non-winning ticket, each of said consumers associated with at least a respective one of a plurality of second opportunity tickets, each second opportunity ticket having a predetermined number of unfilled symbol spots each designated by a respective one of a plurality of symbols and to be filled by said one consumer with said non-winning ticket, and a respective one of the second opportunity tickets, upon completion of filling the symbol spots, being released for play by said consumer in the second opportunity game;

a controller configured for receiving the non-winning ticket, selecting a game piece having a respective one of the symbols from a pool of game pieces, determining whether the selected game piece symbol matches an unfilled symbol spot of one of the second opportunity tickets associated with said consumer, and releasing a completed second opportunity ticket having each of the unfilled symbol spots filled for play in the second opportunity game;

the controller configured for comparing the symbol of the selected game piece with each of the plurality of second opportunity tickets of the respective one of the consumers to find an unfilled symbol spot thereon matching the symbol of the selected game piece and filling the unfilled symbol spot thereof, the controller, upon determining that the symbol associated with the selected game piece does not fill one of the symbol spots of any of the second opportunity tickets associated with the consumer, withdraws the symbol from the pool for said consumer and selects another game piece from the pool, whereby the consumer, being encouraged by the second opportunity ticket, being completed upon filling each symbol spot thereof by withdrawal from the pool of the symbols filled on the second opportunity tickets associated with the consumer, continues to seek tickets from the provider within the retail technology.

2. The system as recited in claim 1, wherein each symbol spot of the respective second opportunity ticket is different from the other symbol spots thereof.

3. The system as recited in claim 1, wherein the pool has one of each of a predetermined number of different symbols from which the symbol is selected.

4. The system as recited in claim 3, wherein the controller selects at random one of the symbols for the consumer having the non-winning ticket.

5. The system as recited in claim 4, wherein the second opportunity ticket has a respective symbol spot for each of the different symbols.

6. The system as recited in claim 1, wherein the controller returns the withdrawn symbol to the pool of symbols after releasing the completed second opportunity ticket for play in the second opportunity game.

7. The system as recited in claim 1, further comprising a communicator operated by the consumer to communicate the non-winning ticket to the controller and to receive from the controller a completion status of the second opportunity tickets for the consumer.

8. The system as recited in claim 7, wherein the communicator comprises a mobile communications device.

9. The system as recited in claim 8, wherein the mobile communications device comprises an imager for creating a digital representation of a ticket identifier for communicating to the controller.

10. The system as recited in claim 9, wherein the controller further comprises a validator that interrogates a database of tickets to determine whether the non-winning game ticket identified by the identifier is valid.

11. The system as recited in claim 8, wherein the communicator further comprises a display screen and configured for displaying the completion status of the second opportunity tickets associated with the consumer.

12. A method of retention of consumers within a retailing technology by completing second opportunity tickets for play of a second opportunity random draw game, comprising the steps of:

(a) offering by a provider within a retail technology offering a plurality of goods to a plurality of consumers at least one random draw game having a plurality of tickets, each ticket for use by a respective one of the plurality of consumers to receive an award based on having a status of a winning ticket as determined from time-to-time by the provider or otherwise said ticket having a status of a non-winning ticket;

(b) offering a second opportunity game by the provider to the consumers, each consumer associated from time-to-time with at least one non-winning ticket and a at least one of a plurality of second opportunity tickets, each second opportunity ticket having a predetermined number of unfilled symbol spots each symbol spot designated by one of a plurality of symbols and to be filled by a symbol selected from a pool of the symbols, and a respective one of the second opportunity tickets, upon completion of filling the symbol spots, being released for play in the second opportunity game;

(c) operating a controller configured for selecting the symbol from the pool of symbols and determining whether the selected symbol matches an unfilled symbol spot of one of the second opportunity tickets associated with the consumer, whereby a completed second opportunity ticket having each of the unfilled symbol spots filled is released for play in the second opportunity game; and (d) the controller further configured for, upon determining that the selected symbol does not fill an unfilled symbol spot of any one of the second opportunity tickets associated with the respective consumer, withdrawing the selected symbol from the pool before repeating step (c);

whereby the completion of the second opportunity ticket by repeating step (c), retains the consumer for the provider within the retailing technology.

13. The method as recited in claim 12, further comprising the step of providing the second opportunity game ticket with symbol spots that differ from the other symbol spots thereon.

14. The method as recited in claim 12, further comprising the step of providing a pool having each one of a predetermined number of different symbols from which the symbol is selected.

15. The method as recited in claim 14, further comprising the step of the controller selecting at random one of the symbols from the pool of symbols.

16. The method as recited in claim 15, wherein the second opportunity ticket provides a symbol spot for each of the different game symbols.

17. The method as recited in claim 12, further comprising the step of returning the withdrawn symbol to the pool of game symbols after releasing the completed second opportunity ticket for play in the second opportunity game.

18. The method as recited in claim 12, further comprising the step of operating a communicator to communicate an identifier of the non-winning ticket to the controller and to receive from the controller a status of the second opportunity tickets associated with the consumer, wherein the communicator comprises a mobile communications device.

19. The method as recited in claim 18, further comprising the step of using an imager of the mobile communications device for creating a digital representation of the identifier of the non-winning ticket for communicating to the controller.

20. The method as recited in claim 12, further comprising the step of the controller interrogating a database of tickets to determine whether the non-winning ticket is valid for the selection of the symbol.

21. The method as recited in claim 18, further comprising the step of displaying on a display screen of the communicator the completion status of the second opportunity tickets associated with the consumer.

22. The system as recited in claim 1, further comprising a database of the second opportunity tickets accessible by the controller, each second opportunity ticket associated with a respective one of the consumers by a unique identifier, the controller configured for maintaining the status of the symbol spots of the second opportunity tickets associated with the consumer.

23. The method as recited in claim 12, further comprising the controller comparing the selected symbol with unfilled symbol spots on each of the plurality of second opportunity tickets of the respective one of the consumers to find an unfilled symbol spot matching the selected symbol and filling the unfilled symbol spot therewith.

24. The method as recited in claim 12, further comprising the step of maintaining a database of second opportunity tickets accessible by the controller, each second opportunity ticket associated with a respective one of the consumers by an identifier.

25. The method as recited in claim 12, further comprising the step of communicating an identifier of the non-winning ticket to the controller and receiving from the controller a status of the second opportunity ticket.

* * * * *